US005127655A

United States Patent [19]

Yamada et al.

[11] Patent Number: 5,127,655

[45] Date of Patent: Jul. 7, 1992

[54] GOLF BALL

[75] Inventors: Mikio Yamada; Kengo Oka, both of Kobe, Japan

[73] Assignee: Sumitomo Rubber Industries, Ltd., Hyogo, Japan

[21] Appl. No.: 636,583

[22] Filed: Jan. 2, 1991

[30] Foreign Application Priority Data

Jul. 27, 1990 [JP] Japan ..... 2-199695

[51] Int. Cl.[5] ..... A63B 37/14

[52] U.S. Cl. ..... 273/232; 273/220

[58] Field of Search ..... 273/232, 62, 220; 40/327

[56] References Cited

U.S. PATENT DOCUMENTS

| | | | |
|---|---|---|---|
| 4,142,727 | 3/1979 | Shaw et al. | 273/232 |
| 4,560,168 | 12/1985 | Aoyama | 273/232 |
| 4,729,861 | 3/1988 | Lynch et al. | 273/232 X |
| 4,744,564 | 5/1988 | Yamada | 273/232 |
| 4,840,381 | 6/1989 | Ihara et al. | 273/232 |
| 4,880,241 | 11/1989 | Melvin et al. | 273/232 |
| 5,024,441 | 6/1991 | Yamagishi et al. | 273/232 |
| 5,033,750 | 7/1991 | Yamagishi et al. | 273/232 |

FOREIGN PATENT DOCUMENTS

| | | |
|---|---|---|
| 53-115330 | 10/1978 | Japan . |
| 57-22595 | 5/1982 | Japan . |
| 58-50744 | 11/1983 | Japan . |
| 60-234674 | 11/1985 | Japan . |
| 63-186469 | 11/1988 | Japan . |
| 1-221182 | 9/1989 | Japan . |
| 2-45074 | 2/1990 | Japan . |
| 2216017 | 4/1989 | United Kingdom . |

*Primary Examiner*—George J. Marlo

[57] ABSTRACT

A golf ball with dimples disposed in a regular octahedral arrangement having a superior symmetrical property so as to arrange dimples symmetrically in each of numerously divided regions without deteriorating the symmetrical property of the golf ball and by varying volumes of dimples adjacent to each other at a specified ratio with diameters thereof equal to each other, thereby to provide a symmetrical property and uniformity for flying a long distance.

8 Claims, 8 Drawing Sheets

PRIOR ART

GOLF BALL

BACKGROUND OF THE INVENTION

1. Field of the Invention

The present invention relates to a golf ball, and more particularly, to the golf ball which is not different in its flight performance depending on a different rotational axis thereof by improving the symmetrical property of dimples arranged thereon and which is improved in the aerodynamic lift and resistance thereof so as to fly the golf ball a long distance by appropriately varying the volume of dimples adjacent to each other.

2. Description of the Related Arts

Normally, 300 to 550 dimples are formed on the surface of a golf ball. Dimples are formed thereon to improve the aerodynamic characteristic thereof while the golf ball is flying so as to fly the golf ball a long distance.

When the golf ball is hit by a club, a backspin is imparted thereto. The rotational axis thereof serves as an important factor for increasing the flight distance thereof and flying it uniformly regardless of whether it is hit on the pole or the seam. It is not preferable for the golf ball to fly a varied distance according to a rotational axis thereof. That is, desirably, the flight distance obtained when it is hit on the seam is equal to that obtained when it is hit on the pole.

A golf ball approved by the golf association can be used in a title match. In the U.K. and the U.S.A., it is essential for golf balls to meet the requirements provided by Royal and Ancient and USGA, respectively. The symmetrical property test is one of the requirements. That is, it is examined whether or not there is a difference in the flight distance of a golf ball depending on a rotational axis, namely, between the seam hitting and the pole hitting.

A golf ball is formed by a split mold comprising upper and lower molds. Accordingly, a burr is formed on the surface thereof due to the seam between the upper and lower molds. It is desirable that the golf ball flies the same distance or in the same trajectory height irrespective of a hitting point, namely, a rotational axis. However, the trajectory height in the seam hitting tends to differ from that in the pole hitting due to the existence of the seam. The seam hitting means that the golf ball is hit in such a manner that the line connecting the poles serves as the rotational axis of the backspin thereof. The pole hitting means that the golf ball is hit in such a manner that a line perpendicular to the above-described rotational axis serves as the rotational axis of the backspin thereof. A golf ball having a great difference in flight distance thereof between the seam hitting and the pole hitting is not officially admitted. In order for a golf ball to be recognized as being superior, it is absolutely necessary that the difference in the flight distance thereof between the seam hitting and the pole hitting is less than the reference value officially recognized. That is, the golf ball is required to have the same flight performance in the seam hitting and the pole hitting and in addition, the same flight distance and trajectory irrespective of a manufacturing method.

As described above, the golf ball is required to have uniformity, namely, symmetrical property in its flight performance. But the following conventional dimple arranging methods are intended to improve the flight performance of the golf ball rather than the symmetrical property thereof: regular icosahedral arrangement shown in FIG. 8 and disclosed in Japanese Patent Publication No. 58-50744, modification of regular icosahedral arrangement of Japanese Patent Laid-Open Publication No. 2-45074, regular dodecahedral arrangement shown in FIG. 9 and disclosed in Japanese Patent Publication No. 57-22595, icosahedral-dodecahedral arrangement shown in FIG. 10 and disclosed in Japanese Patent Laid-Open Publication No. 60-234674, concentric arrangement shown in FIG. 11 and disclosed in Japanese Patent Laid-Open Publication No. 53-115330, and cubic octahedral arrangement shown in FIG. 12 and disclosed in Japanese utility Model Laid-Open Publication No. 63-186469, and Japanese Patent Laid-Open Publication No. 1-221182. Golf balls according to the above proposals have all a plurality of axes of symmetry on the surface thereof, but none of them are at right angles with each other. In addition, dimples are not symmetrical with respect to any one of the axes of symmetry.

In addition to the dimple arranging methods shown in FIG. 8 through 12, the regular octahedral arrangement as shown in FIG. 13 is a fundamental dimple arranging method and has been conventionally adopted since the time when a dimple was developed. According to this dimple arrangement, three axes of symmetry SL1, SL2, and SL3 are at right angles with each other and all dimples D are identical to each other in diameter, depth, and volume. Dimples are arranged symmetrically with respect to each axis of symmetry, thus having a preferable symmetrical property. Therefore, the regular octahedral arrangement is still the main current of dimple arranging methods.

The golf ball having dimples D shown in FIG. 13 formed thereon is preferable in its symmetrical property, however, has a disadvantage in respect of its flight distance. That is, as described previously, the golf ball flies with a backspin imparted thereto when it is hit. In order to fly the golf ball higher, it is required to set the separation point between air and the upper surface of the golf ball as backward as possible compared with the separation point between air and the lower surface of the golf ball so as to make air pressure existing above the golf ball smaller than that existing below the golf ball. The separation of air, from the golf ball, existing above the golf ball can be accelerated by making the air in the periphery thereof turbulent. In order to make air in the periphery of the golf ball turbulent, it is necessary to arrange dimples irregularly on the surface thereof while the symmetrical property and uniformity thereof are maintained in consideration of a favorable balance between the aerodynamic lift and drag brought about by the aerodynamic effect of a dimple.

In view of the above viewpoint, the dimple arrangement as shown in FIG. 13 has a problem in increasing the flight distance of a golf ball because dimples are identical to each other in diameters, depths, and volumes, i.e., dimples are arranged so regularly that air in the periphery of the golf ball does not become turbulent.

Many proposals for forming dimples of different diameters have been made to generate a turbulent air flow in the periphery of a golf ball with a view to increasing the flight distance thereof as disclosed in Japanese Patent Laid-Open Publication No. 60-234674. The golf ball can fly a long distance indeed, but the diameter of the golf ball is ununiform depending on an axis thereof due to diameter-differentiated dimples. Therefore, a line adjustment from a putting point to the hole is difficult and the golf ball does not roll straight depending on a rotational axis.

SUMMARY OF THE INVENTION

The present invention has been developed to solve the problems described above. It is therefore the object of the present invention to provide a golf ball which has a symmetrical property and uniformity and flies a long distance. The object can be achieved by improving the conventional regular octahedral arrangement having a superior symmetrical property so as to arrange dimples symmetrically in each of numerously divided regions without deteriorating the symmetrical property of the golf ball and by varying volumes of dimples adjacent to each other at a specified ratio with diameters thereof equal to each other.

In order to achieve the above-described object, a golf ball according to the present invention has three great circles formed on the surface thereof. The great circles cross at right angles with each other and intersect with none of dimples formed on the surface thereof.

Dimples of a uniform diameter are arranged in each region divided by imaginary lines obtained by projecting a polyhedron consisting of 18 squares and eight equilateral triangles on a circumscribed circle about the polyhedron in such a manner that the dimples do not intersect with any of the imaginary lines.

The volume of at least one of dimples adjacent to a given dimple is differentiated from the volume thereof by more than 10%.

The golf ball in accordance with the present invention has 300 to 600 dimples on its surface. The total volume of dimples ranges from $250cm^3$ to $400cm^3$. The total number of dimples and the total volume of dimples are determined according to a balata ball, surlyn thread-wound ball, one-piece ball, two-piece ball, and three-piece ball.

In each of the square regions and equilateral triangle regions, dimples are arranged symmetrically and the arrangements of dimples are uniform in the square regions and the equilateral triangle regions, respectively.

Preferably, the diameters of dimples arranged in the 18 squares are uniform and/or those of dimples arranged in the eight equilateral triangles are uniform.

According to the golf ball of the present invention, three great circles at right angles with each other are formed on the surface thereof, and dimples are uniformly and symmetrically arranged in each of 18 square regions and eight equilateral triangle regions. Dimples are symmetrical with respect to each of the three great circles, or the three axes of symmetry. Owing to this dimple arrangement, the flight performance of the golf ball is varied in a slight extent irrespective of whether the golf ball is hit on the seam or the pole.

The volume of at least one of dimples adjacent to a given dimple is differentiated from the volume thereof at a specified ratio, namely, by more than 10% with the diameters of all dimples uniform. This arrangement generates an appropriate turbulent air flow in the periphery of the golf ball with the balance between the aerodynamic lift and resistance of the golf ball favorable. Therefore, the golf ball can fly a long distance.

As described above, the flight characteristic of the golf ball is not varied and flies a long distance regardless of whether it is hit on the seam or the pole.

BRIEF DESCRIPTION OF THE DRAWINGS

These and other objects and features of the present invention will become apparent from the following description taken in conjunction with the preferred embodiments thereof with reference to the accompanying drawings. in which.

DETAILED DESCRIPTION OF THE INVENTION

Figure 1A:
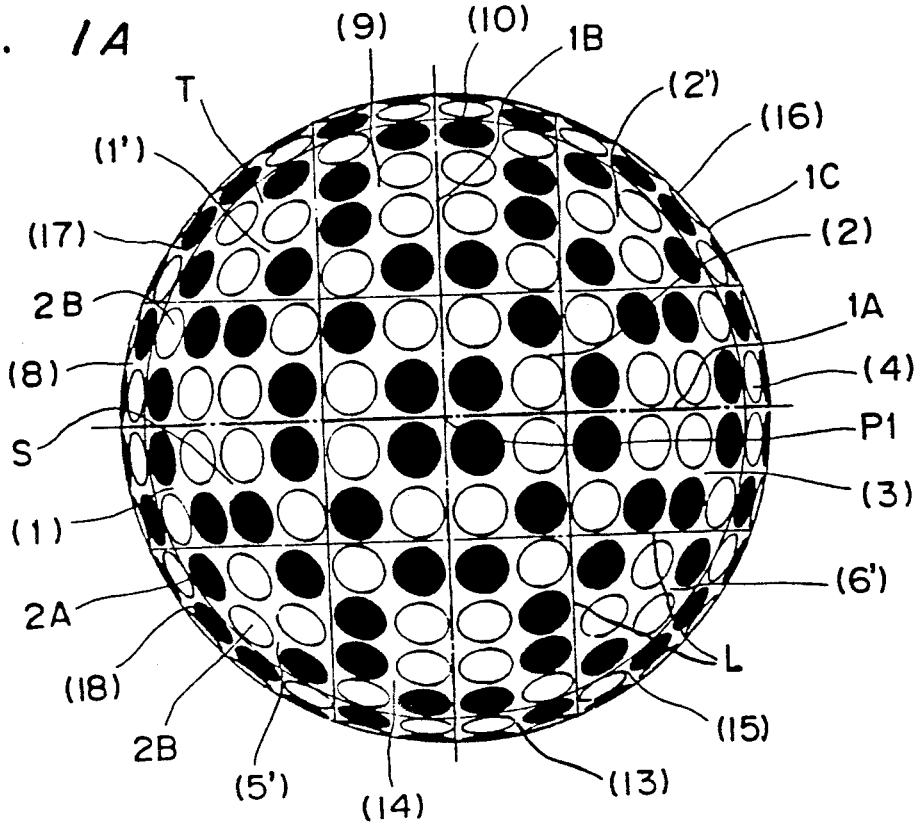
FIG. 1A is a front view showing a golf ball in accordance with a first embodiment.

Before the description of the present invention proceeds, it is to be noted that like parts are designated by like reference numerals throughout the accompanying drawings.

The embodiment of the present invention will be described with reference to the accompanying drawings.

Figure 1B:
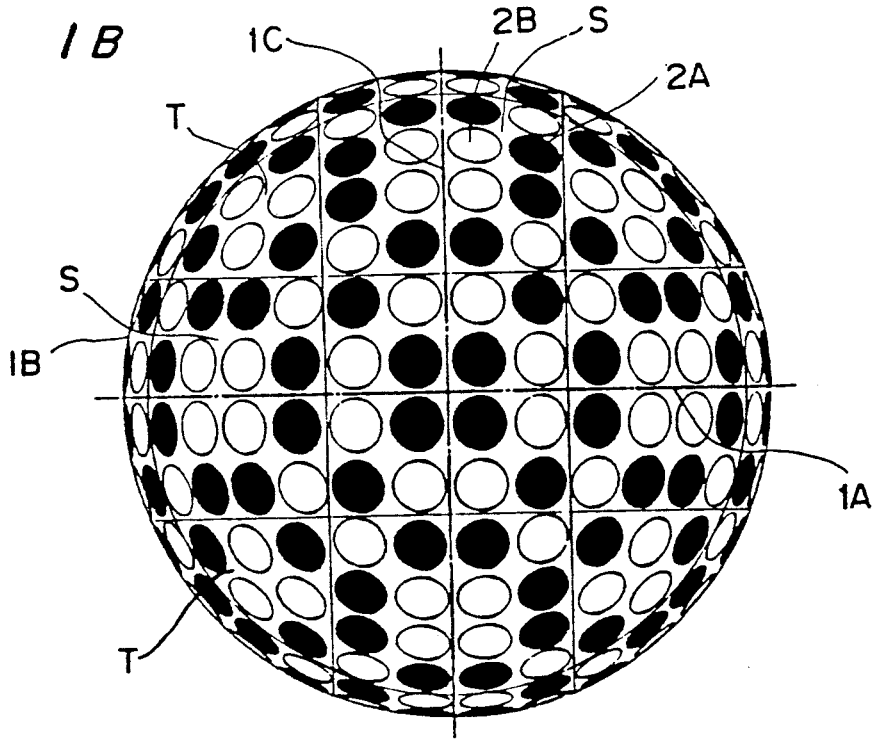
FIG. 1B is a side elevation of the golf ball shown in FIG. 1.

Referring to FIG. 1A and 1B showing a first embodiment in accordance with the present invention, a first great circle 1A, a second great circle 1B, and a third great circle 1C are provided on the surface of a golf ball. The first great circle 1A passes through a center P1. The second great circle 1B passes through the center P1 and is perpendicular to the great circle 1A. The third great circle 1C passes through the poles. The three great circles 1A, 1B, and 1C are at right angles with each other.

Figure 2:
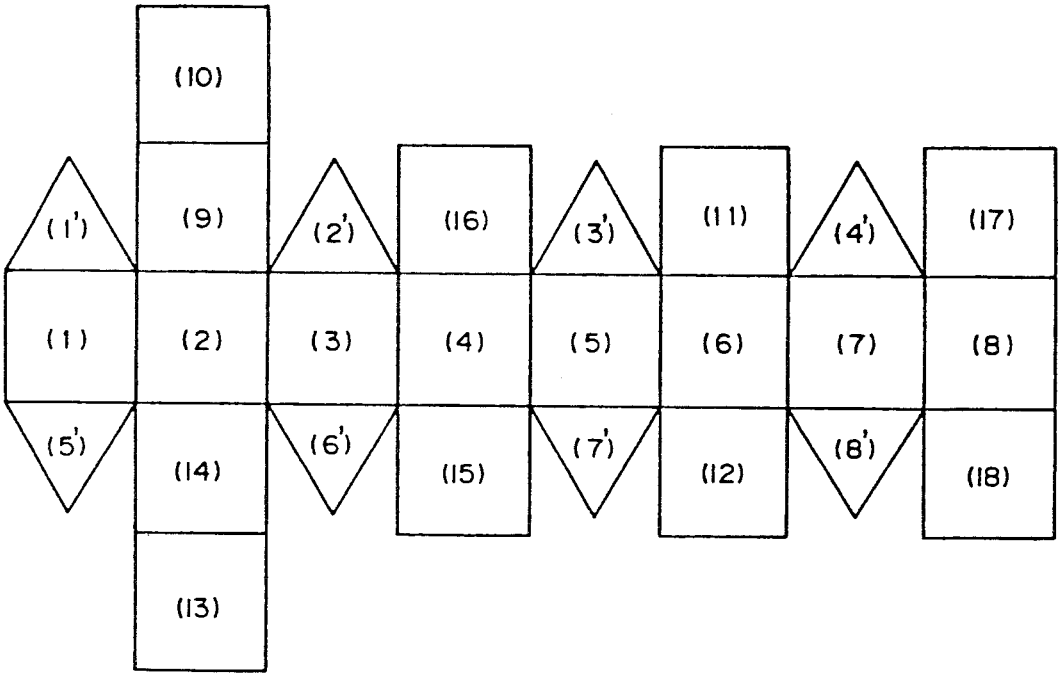
FIG. 2 is a development of a polyhedron for explaining the method for forming divided regions on the surface of a golf ball according to the first embodiment.

Each ridge line of a polyhedron consisting of 18 squares (1) through (18) and eight equilateral triangles (1') through (8') as shown in FIG. 2 is projected on a circumscribed circle about the polyhedron. Thus, imaginary lines serving as dividing lines as shown in FIGS. 1A and 1B divide the surface of the golf ball into 26 blocks. The dividing lines are shown in solid lines L in FIGS. 1A and 1B. As shown in FIG. 1B which is a side elevation of the golf ball shown in FIG. 1A, the surface of the golf ball is similarly divided by the dividing lines into square regions S and equilateral triangle regions T. Although not shown, the surface of the golf ball is similarly divided by dividing lines in the top plan view thereof and the bottom view thereof. More specifically, each elevational surface of the golf ball relative to the orientation of FIGS. 1A and 1B, is divided into five square regions S crosswise in the center thereof, four equilateral triangle regions T on the corners formed by the square regions S, and eight peripheral regions each having the area half the square.

The great circles 1A and 1C bisect the fibe square regions S [(2), (9), (14), (3) and (1)] into 10 rectangular areas. The eight regions each having the area half the square are those regions disposed about the periphery of the ball shown. These are rectangular portions formed by the bisection of the square regions such as (4), (16), (10), (17), (8), (18), (13) and (15) of FIG. 1A by the great circle 1C. Bisection of squares S by the great circle 1C is shown in side elevation in FIG. 1B.

According to the embodiments, dimples 2A, 2B arranged in the 18 square regions S are all uniform in diameter of 3.65 mm. Similarly, dimples 2A, 2B arranged in the eight equilateral triangle regions T are all uniform in diameter of 3.65 mm as well. That is, in the first embodiment, the diameters of all dimples 2A, 2B are identical to each other.

Dimples 2A, 2B are arranged symmetrically in each of the 26 regions S and T. That is, in square regions S, they are symmetrical with respect to at least one of the great circles 1A, 1B or 1C, and in equilateral triangle regions T, they are symmetrical with respect to the bisector of each vertex. More specifically, as shown in FIGS. 1A, 1B, and 3, 16 dimples are symmetrically formed by arranging four dimples in both horizontally and vertically in each square region S. Six dimples are symmetrically formed by arranging three dimples along edges of each equilateral triangle region T. According to this arrangement, 336 dimples are arranged in total on the surface of the golf ball, i.e., $16\times18+6\times8=336$.

Figure 3:
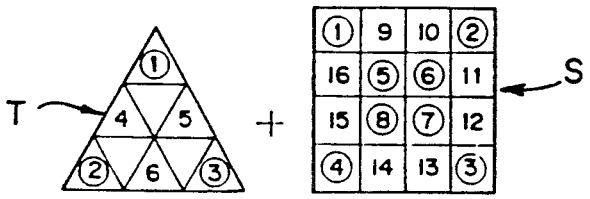
FIG. 3 is a view showing the dimple arrangement of each divided region according to the first embodiment.

According to the embodiments, in order to greatly generate a turbulent flow of air in the periphery of the golf ball, the diameters of the dimples 2A, 2B are uniform, however, the volumes thereof are differentiated as shown by black dimples 2A and white dimples 2B shown in FIGS. 1A and 1B and numerals 1-6 circled and not circled in FIG. 3. The volume of a black dimple 2A is different from to that of a white dimple 2B. The difference between of the volume of the former and that of the latter is more than 10%. The volume of each black dimple 2A is 0.98 $mm^3$ and that of each white dimple 2B is 0.87 $mm^3$. In FIG. 3, a circled dimple numeral corresponds to a black dimple 2A and a dimple numeral not encircled corresponds to a white dimple 2B. The method for arranging the dimples 2A and 2B uniform in diameter is as follows: That is, on the entire surface of the golf ball, at least one dimple 2B is adjacent to one dimple 2A. Further, in each region, dimples 2A and 2B are symmetrically arranged and the number of the dimples 2A is equal to that of the dimples 2B.

In the above-described first embodiment, dimples of two different volumes are formed on the surface of the golf ball, however, dimples may be differentiated in more than two different volumes.

According to the golf ball having dimples arranged thereon in the above-described manner, the dimples are arranged symmetrically with respect to each of the great circles 1A, 1B, and 1C crossing at right angles with each other. Therefore, the golf ball has a superior symmetrical property. Each of the square regions has an equal number of dimples and each of the equilateral triangle regions has also an equal number of dimples. In addition, the dimples are arranged symmetrically and are uniform in diameter. In this respect, the golf ball has a favorable symmetrical property. Accordingly, the difference in the flight performance of the golf ball is slight between the seam hitting and the pole hitting. In addition, the golf ball allows an easy line adjustment in putting toward the hole and rolls straight toward the hole.

Although the diameters of the dimples 2A and 2B are identical to each other, the volume of at least one of the dimples adjacent to a given dimple is differentiated from the volume thereof by more than 10%. Therefore, a great turbulent flow of air can be generated while it is flying, which allows the aerodynamic lift and drag of the golf ball to be appropriately balanced with each other and increases the flight distance thereof.

Figure 4:
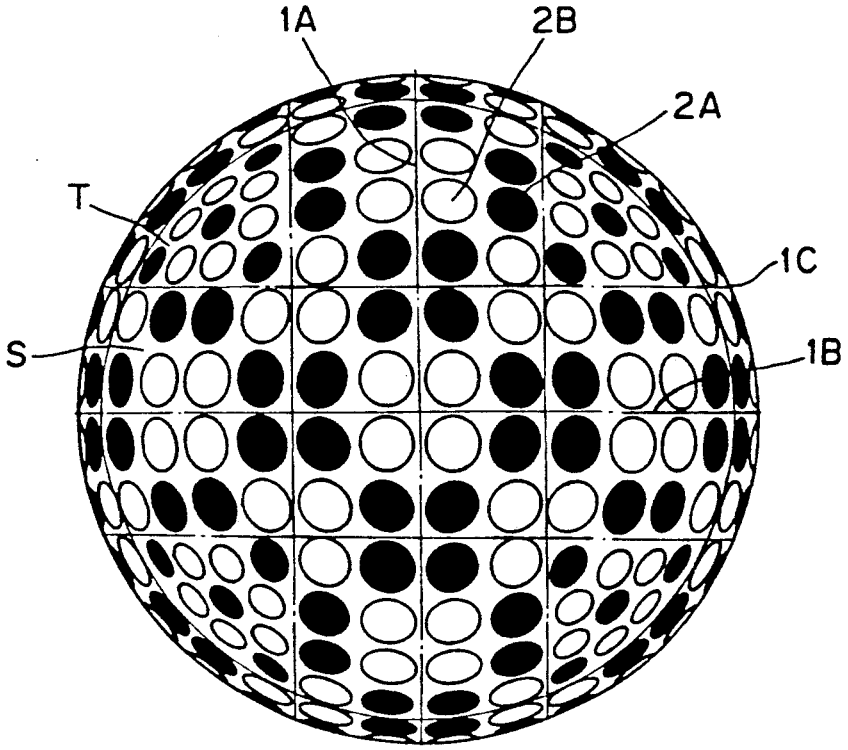
FIG. 4 is a front view showing a golf ball in accordance with a second embodiment.
Figure 5:
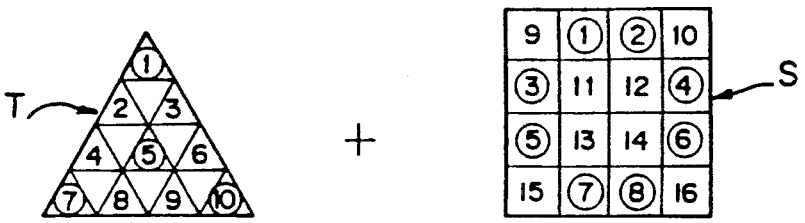
FIG. 5 is a view showing the dimple arrangement of each divided region according to a second embodiment.

FIGS. 4 and 5 show a second embodiment of the present invention. According to the second embodiment, similarly to the first embodiment, each square region S has 16 dimples, but each equilateral triangle region T has 10 dimples. Therefore, the total number of dimples formed on the surface of the golf ball is 368. That is, $16\times18+10\times8=368$. Since the number of dimples is increased in each equilateral triangle region T, the diameter of each of dimples arranged therein is reduced to 3.0 mm while the diameter of each of dimples arranged in each square region S is the same as that of the first embodiment, namely, 3.65 mm.

Similarly to the first embodiment, the dimples of the second embodiment consist of two groups of dimples 2A and 2B different from each other in volume. Similarly to the first embodiment, the dimples 2A and 2B are symmetrically arranged in each region, and the volume of at least one of the dimples adjacent to a given dimple is different from the volume thereof. The dimples 2A are shown in black dots in FIG. 4 and numerical values numeral corresponding thereto are shown by circling them in FIG. 5. The dimples 2B are shown in white dots in FIG. 4 and numerals corresponding thereto are shown by not circling them in FIG. 5.

In addition to the dimple arrangement according to the first and second embodiments, dimples may be arranged as shown in FIGS. 6A, 6B, 6C, and 6D.

Figure 6A:
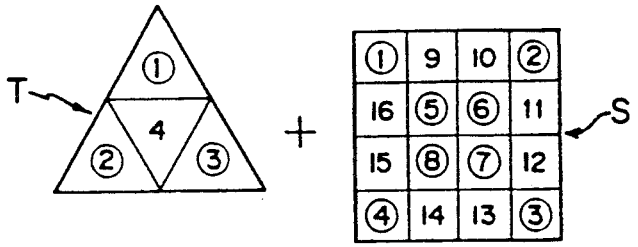
FIGS. 6A, 6B, 6C, and 6D are views each showing the dimple arrangement of each divided region according to other embodiments.

According to the embodiment shown in FIG. 6A, four dimples are formed in each of the eight equilateral triangle regions T and similarly to the first and second embodiments, 16 dimples are formed in each of the 18 square regions S. Therefore, the total number of dimples is 320. That is, $16\times18+4\times8=320$.

Similarly to the above embodiments, according to this embodiment regions of, dimples of two different volumes are formed on the surface of the golf ball. Similarly to the above embodiments, the percentage difference between the volume of a dimple in one to that of a dimple in the other group is more than 10%. Similarly to FIGS. 3 and 5, as shown in FIG. 6A, two groups of dimples are distinguished from each other by circling the numerals of one of the two groups. The dimples are symmetrically arranged in each region and similarly to the above embodiments, the percentage difference in volume is the same as that of the above embodiments. The volume of at least one of dimples adjacent to a given dimple is different from the volume thereof. In embodiments shown by FIGS. 6B, 6C, and 6D, similarly to the above embodiments, dimples of two different volumes are formed on the surface of the golf ball. The percentage difference in volume therebetween is the same as that of the above embodiments. The volume of at least one of dimples adjacent to a given dimple is different from the volume thereof by more than 10%.

Figure 6B:
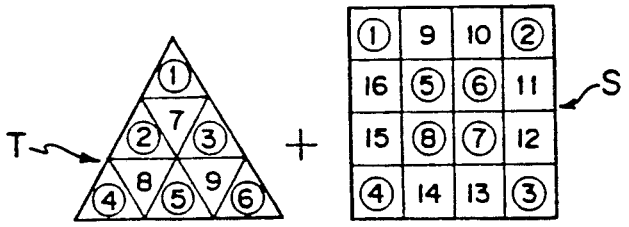

According to the embodiment shown in FIG. 6B, nine dimples are arranged in each of the eight equilateral triangles T and 16 dimples are arranged in each of the 18 square regions S. Therefore, 360 dimples are arranged on the surface of the golf ball. That is, $16\times18+9\times8=360$.

Figure 6C:
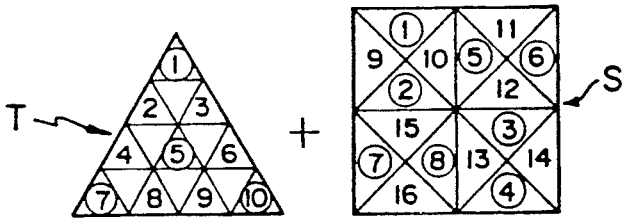
Figure 6D:
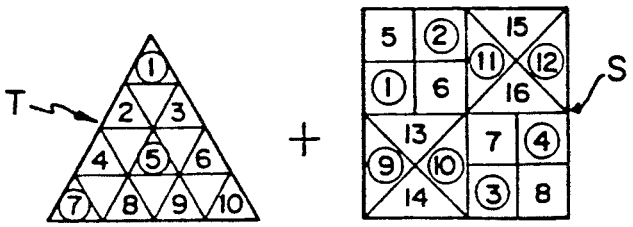
Figure 7A:
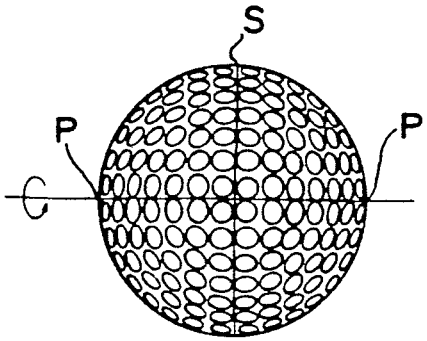
FIGS. 7A and 7B are front views for explaining a seam hitting and a pole hitting.
Figure 7B:
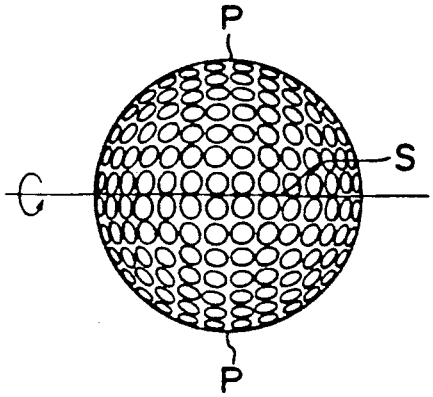
Figure 8:
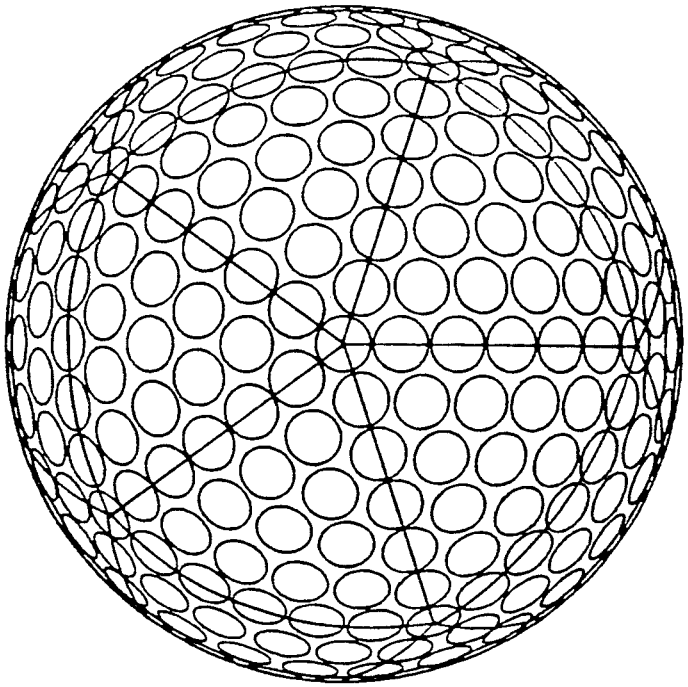
Fig. 8 PRIOR ART
FIG. 8 through 13 are front views for explaining the conventional dimple arrangements as already referred above.
Figure 9:
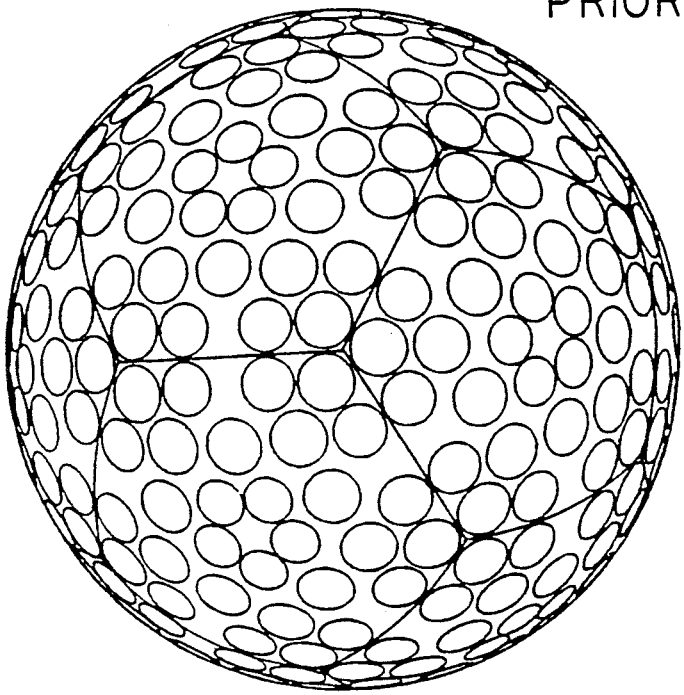
Fig. 9 PRIOR ART
Figure 10:
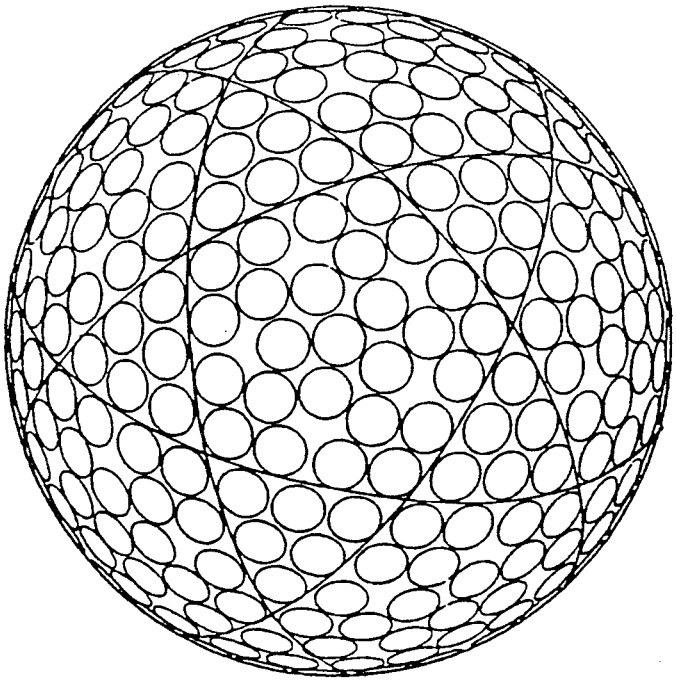
Fig. 10 PRIOR ART
Figure 11:
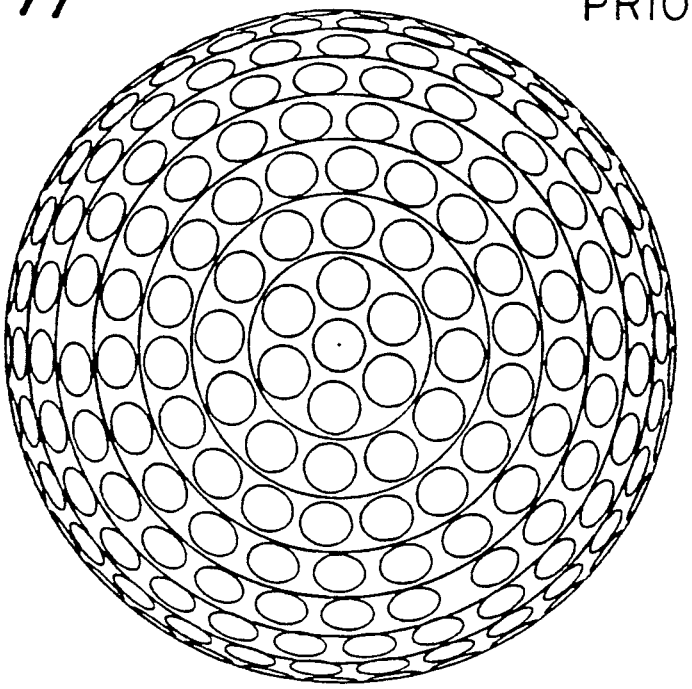
Fig. 11 PRIOR ART
Figure 12:
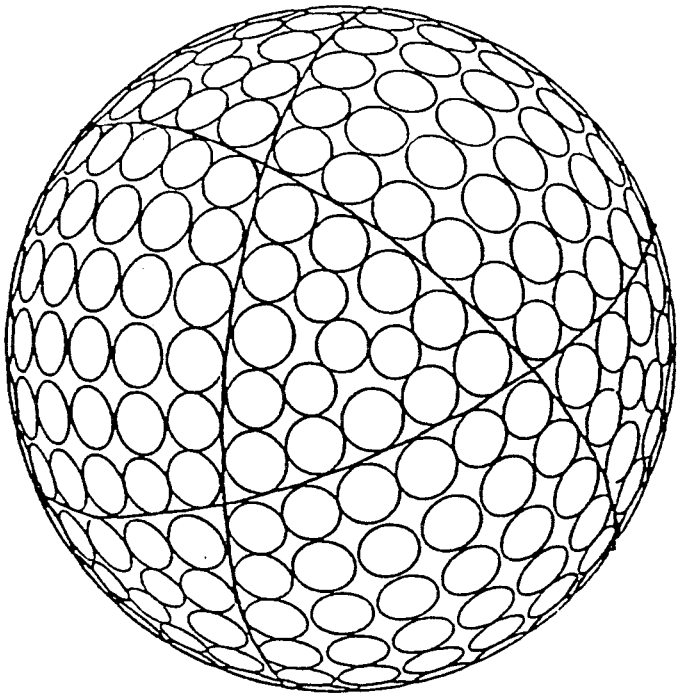
Fig. 12 PRIOR ART
Figure 13:
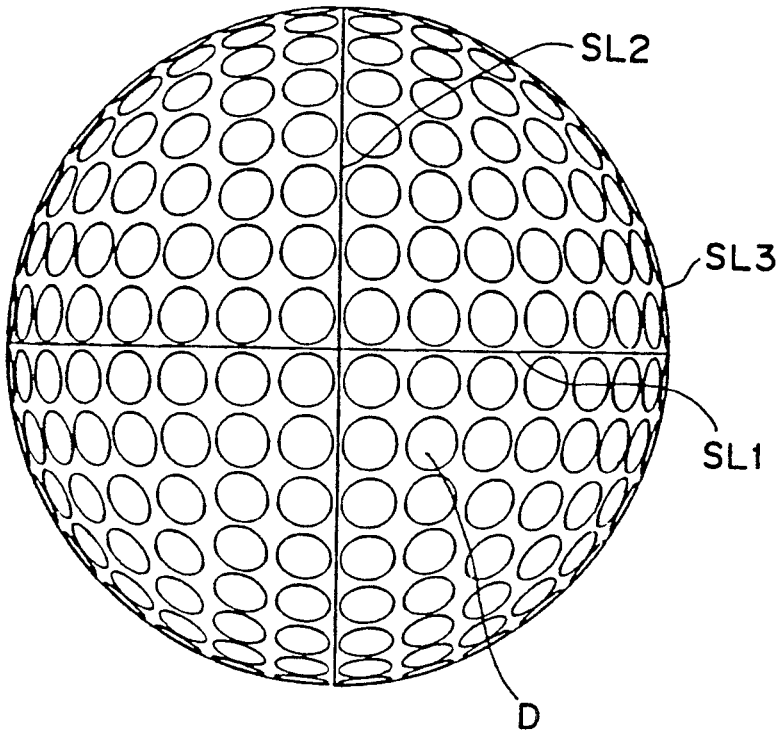

According to the embodiments shown in FIGS. 6C and 6D, similarly to the second embodiment, 10 dimples are arranged in each of the eight equilateral triangle regions T and 16 dimples are arranged in each of the 18 square regions S. Therefore, the total number of dimples arranged on the surface of the golf ball is 368. That is, $16\times18+10\times8=368$. As shown in FIGS. 6C and 6D, in each square region S, dimples are arranged in a manner different from that of the above embodiments, respectively.

EXPERIMENT

Flight distance tests were conducted on two-piece golf balls having the dimple pattern in accordance with the first embodiment and two-piece golf balls, serving as a comparison, of the conventional regular octahedral arrangement.

In order to form cores 38.4 mm in diameter, materials were mixed according to the proportion shown in Table 1 below and kneaded by an internal mixer to form a cylindrical plug. The plug was vulcanized in a press die at 150° C. for forty minutes. Each core was covered with a material of SURLYN 1707 and titanium oxide which has been mixed in the weight percentage of 100 : 2 and molded by an injection. As a result, golf balls of 42.8 mm in diameter were manufactured. Then, a burr was removed from each golf ball and then, each golf ball was coated with paint.

TABLE 1

| material | weight percentage |
|---|---|
| JSR BR01 | 100 |
| zinc acrylate | 34 |
| zinc oxide | 17 |
| DCP | 1.0 |

The specifications of golf balls in accordance with the first embodiment nd the conventional golf balls manufactured as above are as shown in Table 2 below.

TABLE 2

| | first embodiment | comparison |
|---|---|---|
| ball diameter | 42.8 | 42.8 |
| number of dimples | 336 | 336 |
| dimple diameter (mm) | 3.65 | 3.65 |
| volume of dimple (2A) ($mm^3$) | 0.98 | 0.92 |
| volume of dimple (2B) ($mm^3$) | 0.87 | — |
| total dimple volume ($mm^3$) | 311 | 309 |
| compression (PGA system) | 100 | 100 |
| ball weight (g) | 45.4 | 45.4 |
| initial ball speed (m/s) | 64.1 | 64.0 |

Using a swing robot manufactured by True Temper Co., Ltd., golf balls of the first embodiment and the conventional golf balls were hit at a head speed of 45 m/s with a No. 1 wood (driver). Wind was fair at a speed of 2~3 m/s. The green was smooth. Eight balls were prepared for both the comparison all and the ball according of the first embodiment. In order to examine the symmetrical property of the test balls, each ball was beam-hit sand pole-hit two times each. Therefore, each numerical value of pole hitting and seam hitting shown in /Table 3 is the average of two-time hittings.

TABLE 3

| | first embodiment | | comparison | |
|---|---|---|---|---|
| | pole | seam | pole | seam |
| carry (yard) | 222.8 | 222.2 | 218.8 | 218.3 |
| total (yard) | 229.6 | 229.2 | 224.7 | 224.1 |
| trajectory height | 13.2 | 13.1 | 13.3 | 13.0 |

As shown in Table 3, the golf ball in accordance with the present invention flies longer than conventional golf ball and has less difference than the conventional golf ball in the trajectory height regardless whether it is hit on the pole or the seam.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A golf ball comprising:

three great circles formed crossing at right angles with each other on the surface thereof; and dimples of a uniform diameter arranged in each region divided by imaginary lines obtained by projecting a polyhedron consisting of 18 squares and eight equilateral triangles on a circumscribed surface about the polyhedron so that the dimples do not intersect with any of said imaginary lines; in each region the volume of at least one of the dimples adjacent to a given dimple being differentiated from the volume thereof by more than 10%.

2. The golf ball as claimed in claim 1, wherein the dimples are symmetrically and uniformly arranged in each of said square and equilateral triangle regions and the dimples are symmetrical with respect to each of said three great circles.

3. The golf ball as claimed in claim 2, wherein the diameters of the dimples arranged in said squares are uniform and those of the dimples arranged in said equilateral triangles are uniform.

4. The golf ball as claimed in claim 2, wherein the diameters of the dimples arranged in said squares are uniform.

5. The golf ball as claimed in claim 2, wherein the diameters of the dimples arranged in said equilateral triangles are uniform.

6. The golf ball as claimed in claim 1, wherein the diameters of the dimples arranged in said squares are uniform and those of the dimples arranged in said equilateral triangles are uniform.

7. The golf ball as claimed in claim 1, wherein the diameters of the dimples arranged in said squares are uniform.

8. The golf ball as claimed in claim 1, wherein the diameters of the dimples arranged in said equilateral triangles are uniform.

* * * * *